US005904167A

United States Patent [19]

Moye

[11] Patent Number: 5,904,167

[45] Date of Patent: May 18, 1999

[54] ONE LEGGED TWO HANDED WALKING DEVICE

[76] Inventor: John F. Moye, 142 Lower Oak Ridge Rd., Cool Ridge, W. Va. 25825

[21] Appl. No.: 08/922,028

[22] Filed: Sep. 2, 1997

[51] Int. Cl.[6] ..... A45B 1/00

[52] U.S. Cl. ..... 135/65; 135/72; 135/74; 135/76

[58] Field of Search ..... 135/67, 65, 68, 135/66, 71, 72, 73, 76, 74, 69

[56] References Cited

U.S. PATENT DOCUMENTS

| | | | |
|---|---|---|---|
| D. 188,784 | 9/1960 | Campbell | D12/130 |
| D. 291,791 | 9/1987 | Bean | D15/11 |
| 2,159,301 | 5/1939 | Upton | 135/67 |
| 2,388,778 | 11/1945 | Wheeler | 135/68 |
| 2,516,852 | 8/1950 | Burry | 135/49 |
| 2,518,763 | 8/1950 | Du Bois | 155/22 |
| 2,527,180 | 10/1950 | Evens | 135/53 |
| 2,528,706 | 11/1950 | Osborn | 135/53 |
| 2,544,957 | 3/1951 | Henry | 135/50 |
| 2,552,902 | 5/1951 | Miley | 135/52 |
| 2,554,653 | 5/1951 | Wisecarver | 135/53 |
| 2,568,654 | 9/1951 | Neptune | 135/50 |
| 2,575,681 | 11/1951 | Peters | 135/68 |
| 2,738,830 | 3/1956 | Black | 155/22 |
| 2,788,793 | 4/1957 | Abbott | 135/68 |
| 2,798,533 | 7/1957 | Frank | 135/22 |
| 3,157,187 | 11/1964 | Murcott | 135/68 |
| 4,245,659 | 1/1981 | Shofner | 135/68 |
| 4,411,283 | 10/1983 | Lucarelli | 135/67 |
| 4,796,648 | 1/1989 | Goulter | 135/65 |
| 4,809,725 | 3/1989 | Champigray | 135/75 |
| 5,188,138 | 2/1993 | Yamasaki | 135/65 |
| 5,188,139 | 2/1993 | Garelick | 135/67 |
| 5,193,567 | 3/1993 | Razny | 135/68 |
| 5,217,419 | 6/1993 | Harwood | 135/65 |
| 5,318,058 | 6/1994 | Zimmerman | 135/68 |
| 5,402,587 | 4/1995 | Buschbacher | 135/67 |
| 5,673,719 | 10/1997 | Shofner | 135/68 |

FOREIGN PATENT DOCUMENTS

| | | | |
|---|---|---|---|
| 2591870 | 6/1987 | France | 135/65 |

*Primary Examiner*—Lanna Mai

[57] ABSTRACT

A walking aid device has a curved handle member designed to conform to the shape of the body which will allow a person to lean on the device when the hands and arms need to be free while standing. The handle member curves downwardly, slightly forwardly and continuing in a downward bow to connect to an appendage or shaft portion. The shaft portion bends slightly inwardly and continues straight down to a foot member. The walking aid device allows a person to walk with the momentum of using a cane and the stability of using a walker.

7 Claims, 13 Drawing Sheets

BREAKDOWN CONFIGURATIONS

STORAGE CONFIGURATION

CANE CONFIGURATION

FRONT VIEW

SIDE VIEW

ANGLE VIEW

ONE LEGGED TWO HANDED
WALKING AID DEVICE

ONE LEGGED TWO HANDED WALKING DEVICE

BACKGROUND—FIELD OF INVENTION

This invention relates to a waling device for the walking impaired which allows for freedom of movement in congested areas, sloped areas, stairs and open areas, such as walking tracks, for maneuverability of both the upper and lower torso.

BACKGROUND—DESCRIPTION OF PRIOR ART

People with walking impairments have a limited number of choices of walking aids. These aids are also limited in their intended method of use. Existing walking aids such as walkers can, in some cases, impede the user form comfortably executing movements on stairs, in congested areas and even on level fields.

Present walking aids having two legs (U.S. Pat. No. 5,217,419 to Harwood Jun. 8, 1993 and Des. U.S. Pat. No. 291,791 to Bean Sep. 8, 1987) three legs (U.S. Pat. No. 2,159,301 to Upton May 23, 1939 and Des. U.S. Pat. No. 188,784 to Campbell Sep. 13, 1960) or four legs (U.S. Pat. No. 5,188,139 to Garelick Feb. 23, 1993, U.S. Pat. No. 2,798,593 to Frank Jul. 9, 1957 and U.S. Pat. 04,411,283 to Lucarelli Oct. 25, 1983), are basically designed for stability and/or relieving weight from a severe impairment. Consequently, a multitude of problems become present when an impaired person is not on level walking areas or loses the ability to maintain momentum and mobility during the walking process. Walking devices having only one leg and a single handgrip (U.S. Pat. No. 4,796,648 to Goulter Jan. 10, 1989) are used for minor impairments. Some canes have what is called a quad foot U.S. Pat. No. 5,402,587 to Buschbacker Apr. 4, 1995), which is a large base at the foot of the cane with four smaller feet connecting to the base. This creates a steady foundation but the stress on the shoulder, arm and wrist still poses a problem for persons needing more support or someone with weak upper limbs such as an arthritic person.

Some impairments are too severe for the use of a single cane, therefore, two canes, a walker or crutches must be used. If two canes must be used for added stability the weight of the patient is distributed from cane to cane during the walking process which means the walking path must be wider due to the fact that the canes are placed to either side of the patient. Also, when one or both hands are needed for something other than balance or stability the canes must be set aside in some fashion to free the hand or hands so that a task can be accomplished.

The walker described in Lucarelli is difficult to walk with because it is heavy. The walkers described in both Lucerelli and Campbell are difficult to use on stairs because they are not relatively coplanar near the bottom. The walkers described in both Lucarelli and Bean prevent the user from taking more than one or two small steps before the walker must be moved. It is desirable that a walker or walking device allow a user to take several normal steps before being moved and allow for easy ascension and descent of steps. The walking device should not be so heavy as to make it difficult to move. The walker described in Harwood allows the user to take longer and more steps, however, it does not allow for maximum versatility in the upper body stride or the motion of the arms which is so important in the normal walking process. Balance, due to directional change can also become a problem since the user is walking between the two leg shafts. The possibility of entanglement becomes more apparent because the user must place the feet from side to side in a quick motion and then swing the walker to the appropriate side before proceeding.

When the user of a walker is moving in a given direction and wishes to reverse the direction, the walker has to be raised and set at an angle around the user and the user has to position him/her self in order to line up with the walker, then the process must be repeated in order to achieve the desired direction.

With the one- legged two-handed walking aid device the walking path does not have to be any wider than the shoulder width of the patient and can even be less than this width. The patient can use one or both hands and if necessary use the walking device for balance by leaning on it. This frees the hands and still allows for stability. The weight of the user can be distributed from side to side with the one-legged two-handed walking aid device much the same way one would do with two canes, but with a more compact radius of use. The foot of the device can be placed quickly and efficiently in front or to the side of the user to allow for maximum balance in most any situation. When the user of a one-legged two-handed walking aid device needs to go in the opposite direction they simply turn the handle member, step around the pivoting foot while holding the handle member and continue walking in the opposite direction without loss of momentum. Bearing weight where necessary continues throughout this process much the same as a person would while walking normally. The natural motion used with the one-legged two-handed walking aid device allows for walking relatively comfortably on uneven surfaces and up and down stairs. The user is actually taking advantage of the upper body to compensate for lower body disadvantages. The one-legged two-handed walking aid device can be broken down to be used as a single handed cane if a particular situation dictates the need for this. An example of such a situation would be if a user were in a cafeteria-style restaurant and it was necessary to have a free hand to carry a tray. The material used in this device is light enough to provide for easy maneuverability, yet sturdy enough to withstand maximum weight and pressure and durable enough to maintain effectiveness rough every day usage.

OBJECTS AND ADVANTAGES

Accordingly, besides the objects and the advantages of the one-legged-two-handed walking aid device described above, several objects and advantages of the present invention are:

(A) to provide versatility and convenience to persons using walking aides by having single appendage member which allows easier access in areas that are otherwise difficult, such as stairs, small doorways and uneven ground and inclines;

(B)to provide stability by the user being able to use two hands, increasing balance;

(C)to provide better mobility by the design being compatible with the natural movement of the body;

(D)to provide comfort by relieving stress and fatigue normally associated with other types of walking aides.

Further objects and advantages are to provide a walking device which is lightweight, easy to handle and incorporates natural and instinctive mobility aspects. For instance, a notable natural motion such as the natural swinging of the arms when walking becomes incorporated in the rowing motion which ultimately is a primary action in the use of the one-legged-two-handed walking aid device so that the upper body is actually taking on part of the burden of the walking process for the walking impaired. Other notable characteristics of the device include: the curved shape of the leg shaft so designed not only to keep the foot of the device out of the way of the user but also to initiate a slight hooking action when the user places the device out away from the body and begins the walking process by bringing it toward the body enabling the user to pull himself forward, at which point the angle of the device has changed, increasing the height hereto, causing an automatic climbing effect; and also there is the slight springing action of the handle member when weight is applied on it that aides to cushion the user during walking. Furthermore, a type of erect crawling action is taking place. The curved handle member promotes more precise control of the placement of the foot, not just for leaning comfort. Due to the curved shape of the handle member the hand placement is at the medium of the turning radius of the wrist, a natural and most comfortable placement. There is no undue stress on the wrist. The handle member does not roll in the hands during placement of the foot. While bearing weight on the cane the handle member can be rocked from side to side without loss of balance. The support is still directly over the foot or the fulcrum. The foot is unlikely to slip by these means. Hereby, making for added confidence for the user. The foot of the cane can be disposed along either side of the user or between the legs during the last stage of the walking process, at which time the user may be turning right, left or backing up.

The combination of the heretofore mentioned objects and advantages as characteristics and the ergonomic design of this one-legged-two-handed walking aid device together, as a whole, provide a lightweight, easily manufactured, walking aide providing means for natural adaptability.

DRAWING FIGURES

REFERENCE NUMERALS IN DRAWINGS

| | | | |
|---|---|---|---|
| 08 | handle | 10 leg shaft | 12 foot pad |
| 14 | telescopic leg adjustment | 16 end cap | 18 handle padding |
| 20A | hinge for cane configuration | 22 swivel pivot | |
| 20B | hinge for storage configuration | | |

SUMMARY

Comprising more control, stability, versatility and balance, the one-legged-two-handed walking aid device is ergonomically designed to conform to natural and instinctive movements of the body enhancing better maneuverability and comfort to the walking impaired.

DESCRIPTION—FIGS. 1–6

Figure 5:
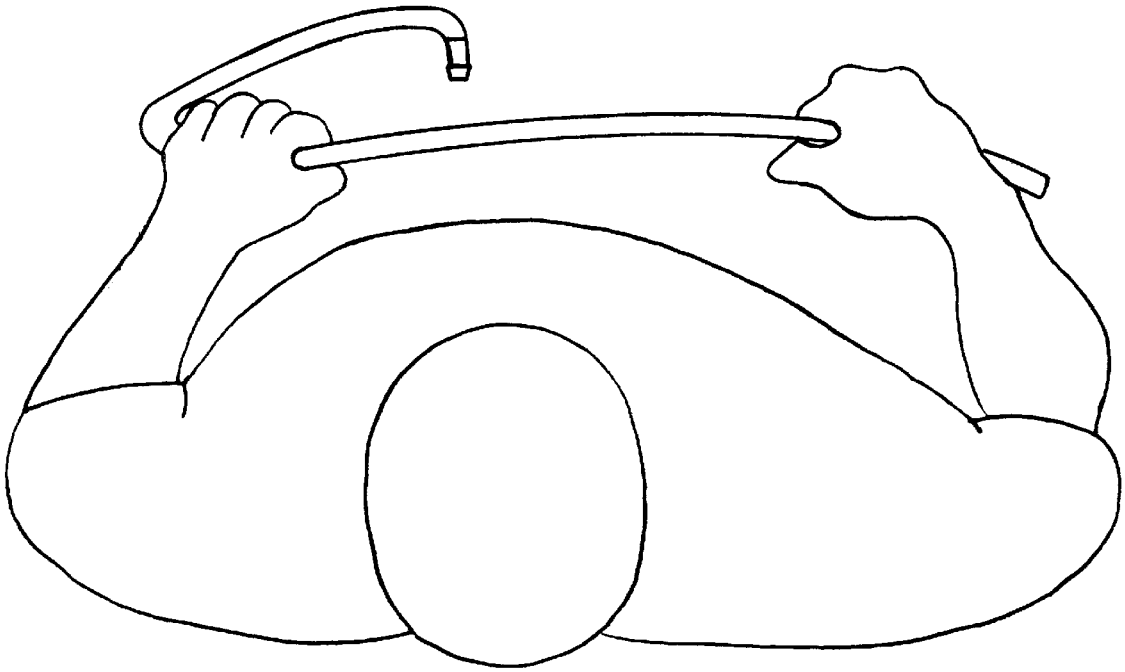
FIG. 5 shows a top view, looking down at the one-legged-two-handed walking aid device.
Figure 6A:
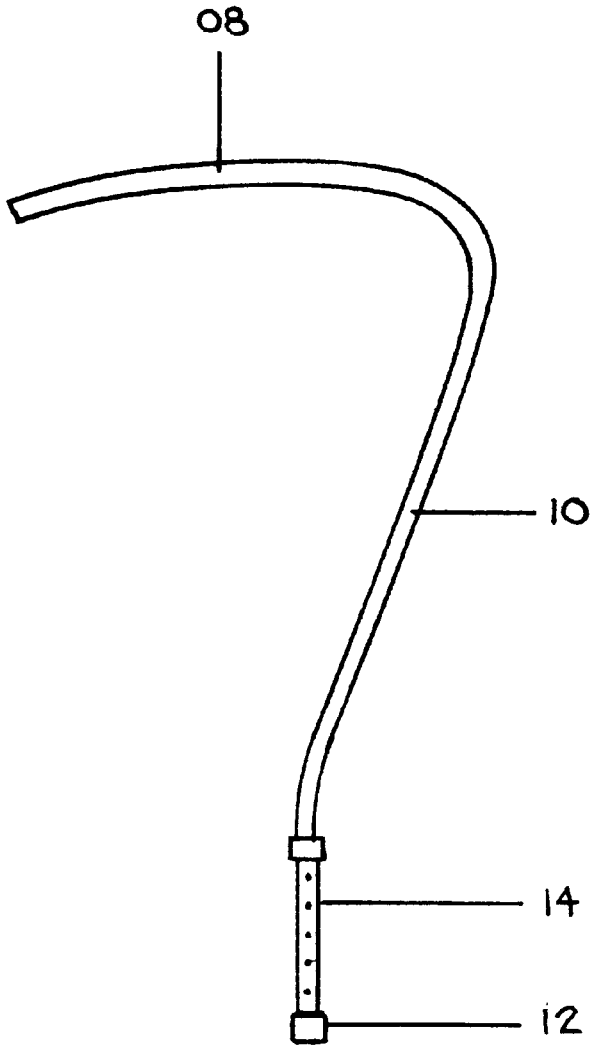
FIG. 6A shows the front view of the one-legged-two handed-walking aid device.
Figure 6B:
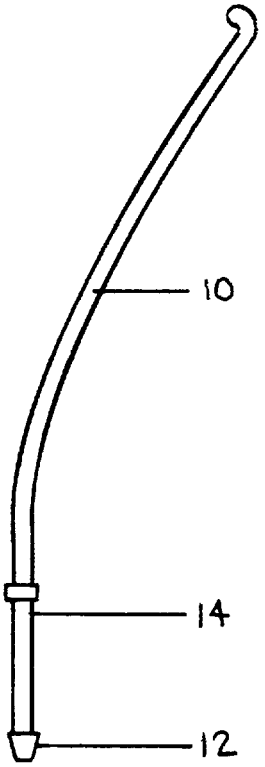
FIG. 6B shows a the true side view of the one-legged-two-handed walking aid device.
Figure 6C:
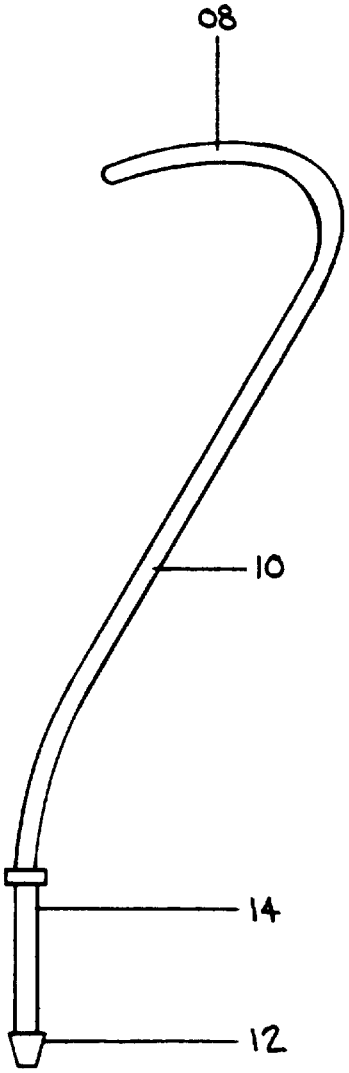
FIG. 6C shows an angled view of the one-legged-two-handed walking aid device.

A typical embodiment of the one-legged-two-handed walking aid device of the present invention is illustrated in FIG. 6A (front view), FIG. 6B (side view) and FIG. 6C (angled view). This one-legged-two-handed walking aid device comprising a handle member 08 which curves FIG. 5(Top View) to conform to the shape of the body, to make for a comfortable hand placement position and also to prevent the handle member from rolling during placement of the foot. The device has a single leg (10) which is an extension of the handle piece extending from either side of the handle member depending on left or right hand user. The appendage member curving downward, inward FIG. 6A and slightly forward and continuing in a downward bow to approximately three-quarters the distance down the length of the shaft to a point 6B which is perpendicular to the approximate center point of the handle FIG. 6A and FIG. 5, here the shaft bends slightly inward and continues on straight to the foot (12) of the one-legged-two-handed walking aid device and herein embodies the telescopic height adjustment (14) and it being coplanar to the user FIG. 6B and FIG. 5.

This one-legged-two-handed-walking aid device is comprised of a sturdy, lightweight material such as aluminum, or alloys thereof, or a titanium type of material, but not limited to any particular material.

Figure 1A:
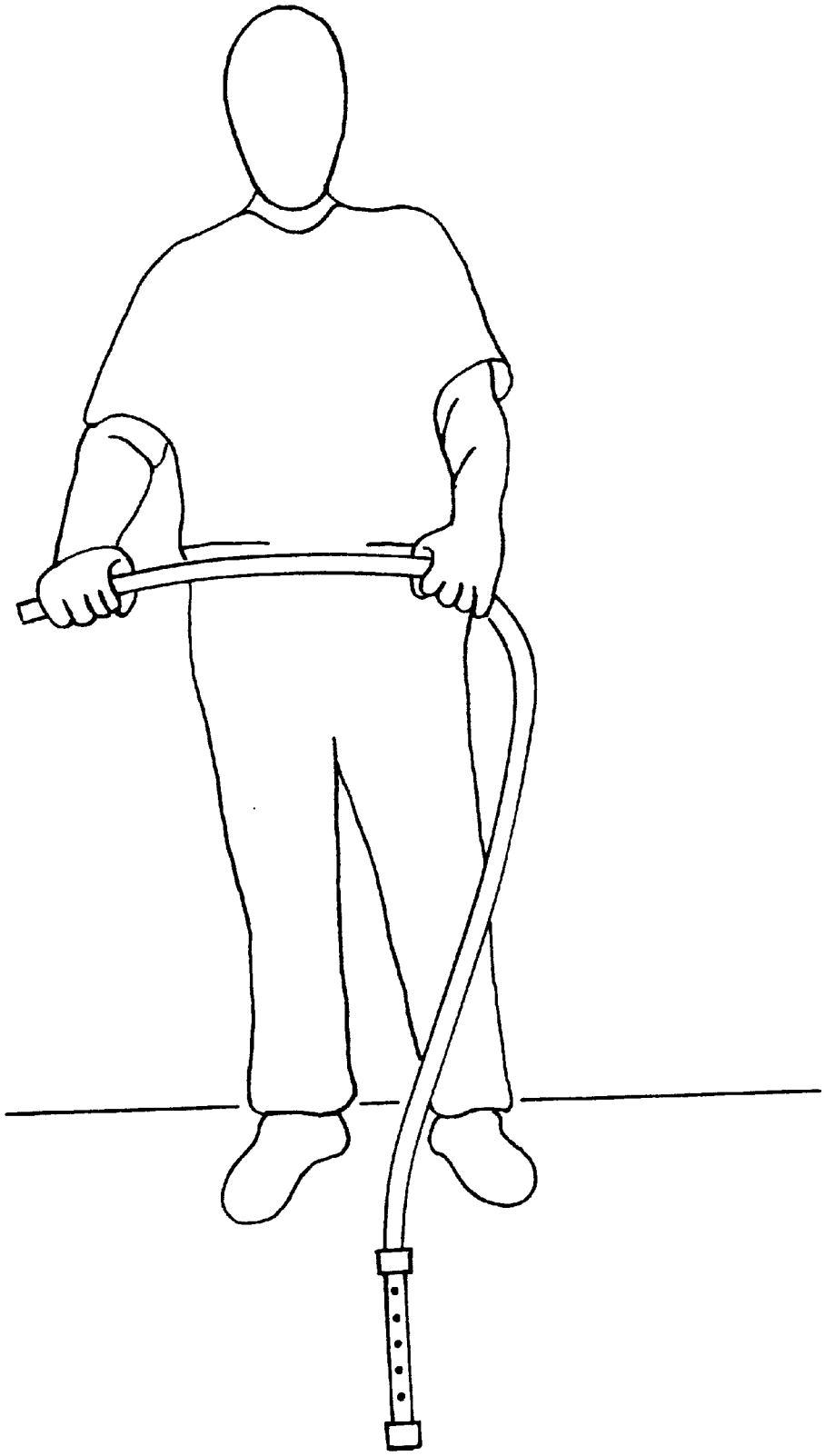
FIGS. 1A to 1C show the process of using the one-legged-two-handed walking aid device.
Figure 1B:
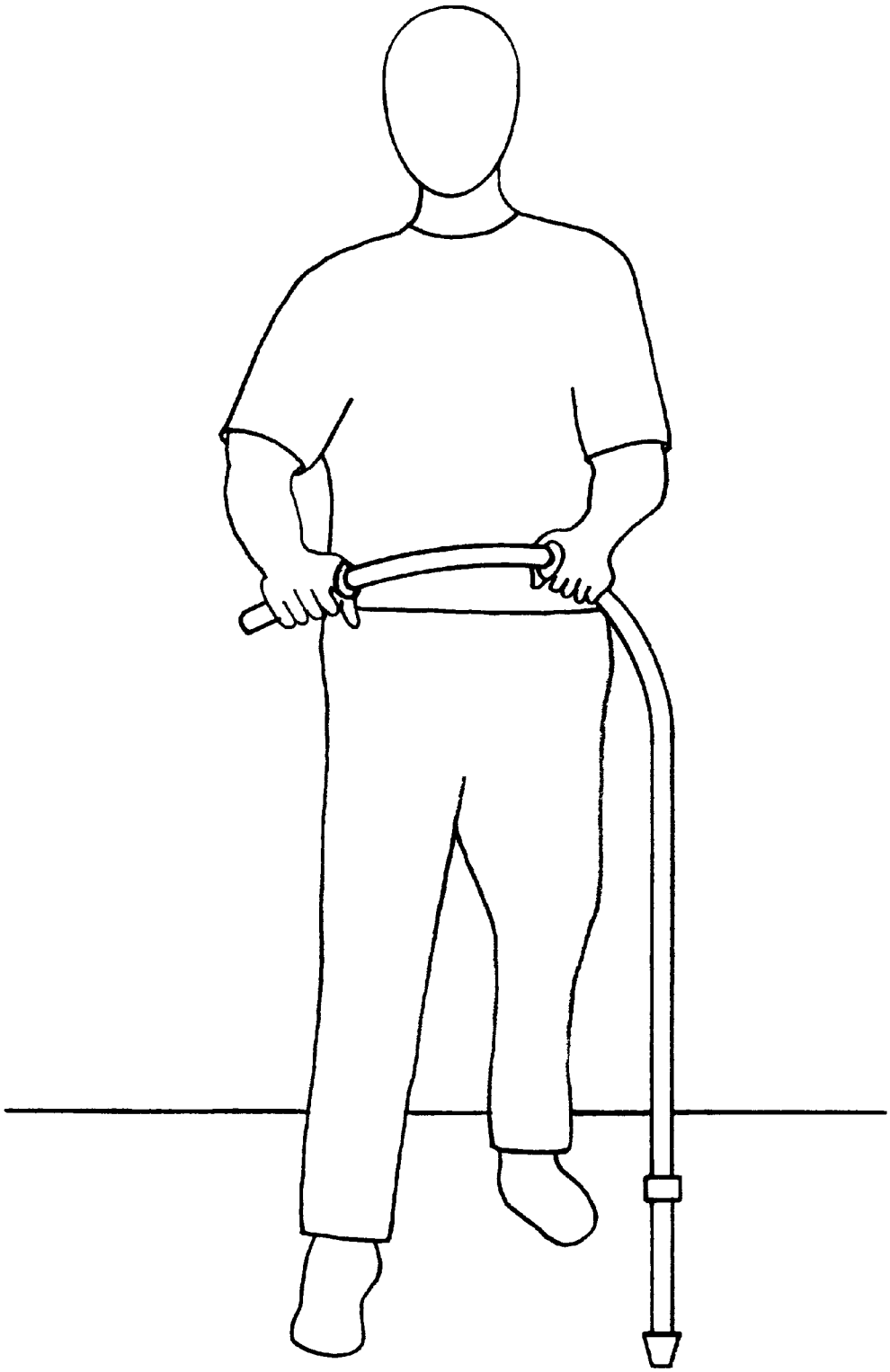
Figure 1C:
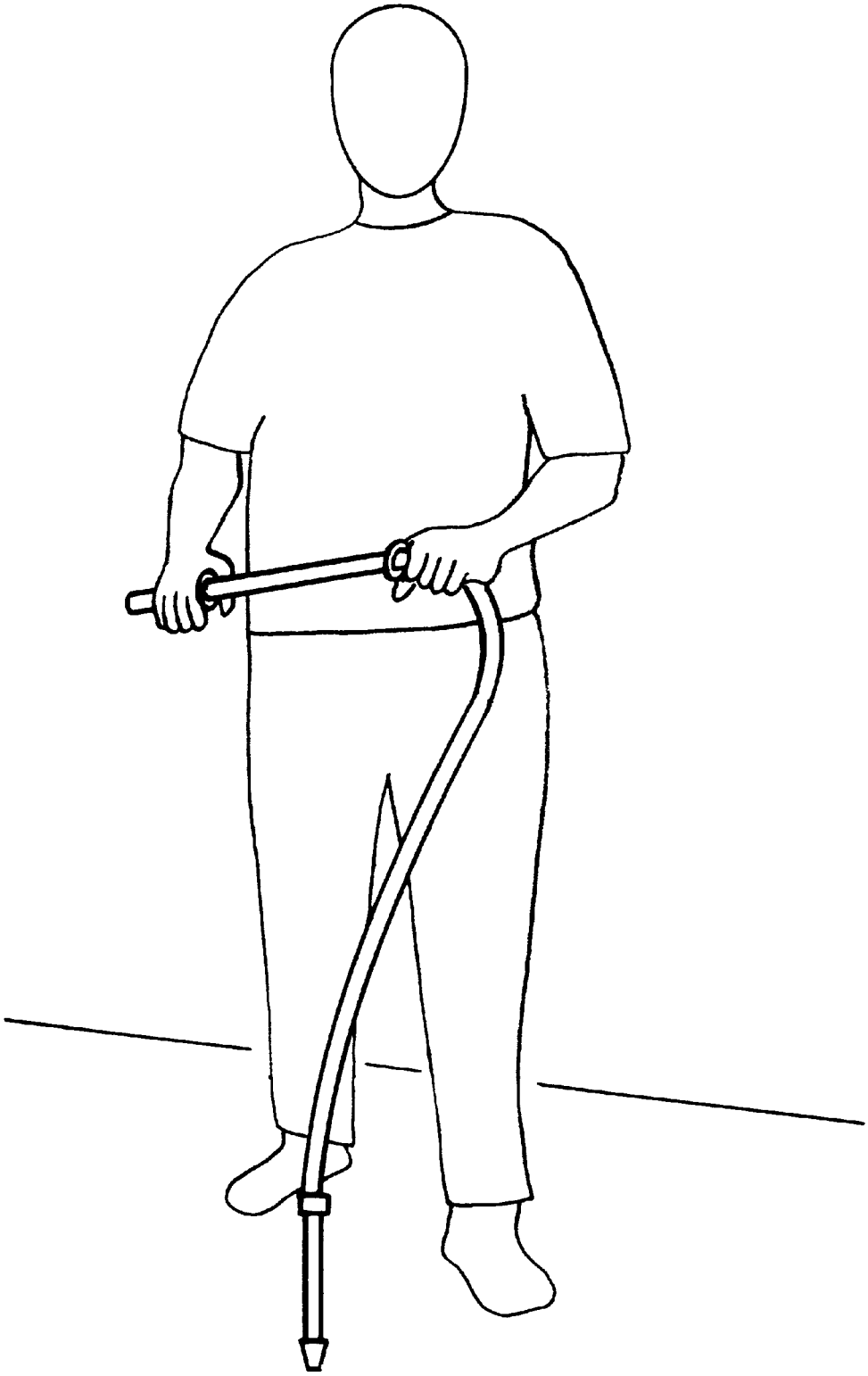
Figure 2A:
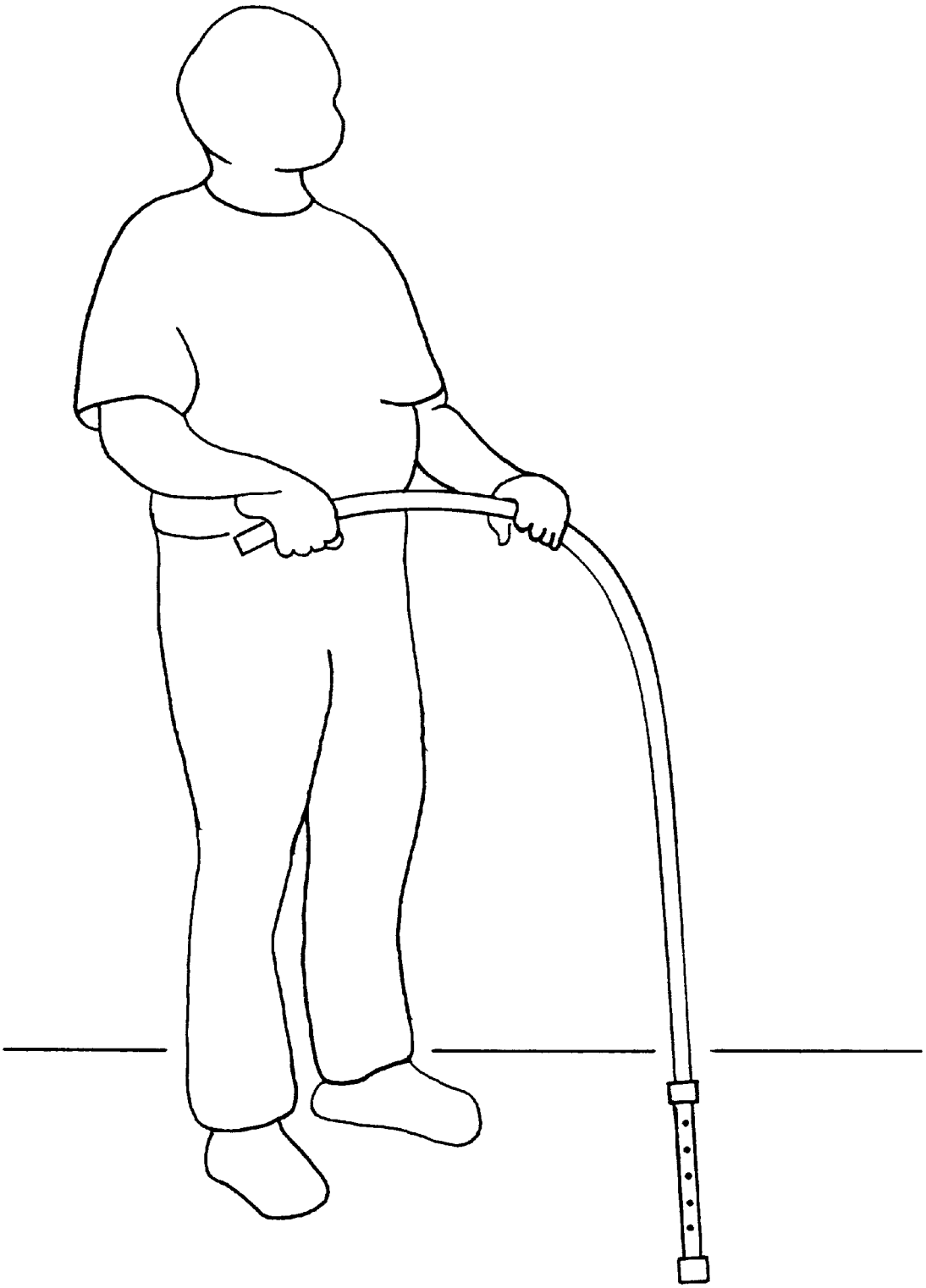
FIGS. 2A to 2C show an angled side view of FIGS. 1A to 1C (process of usage) of the one-legged two-handed walking aid device.
Figure 2B:
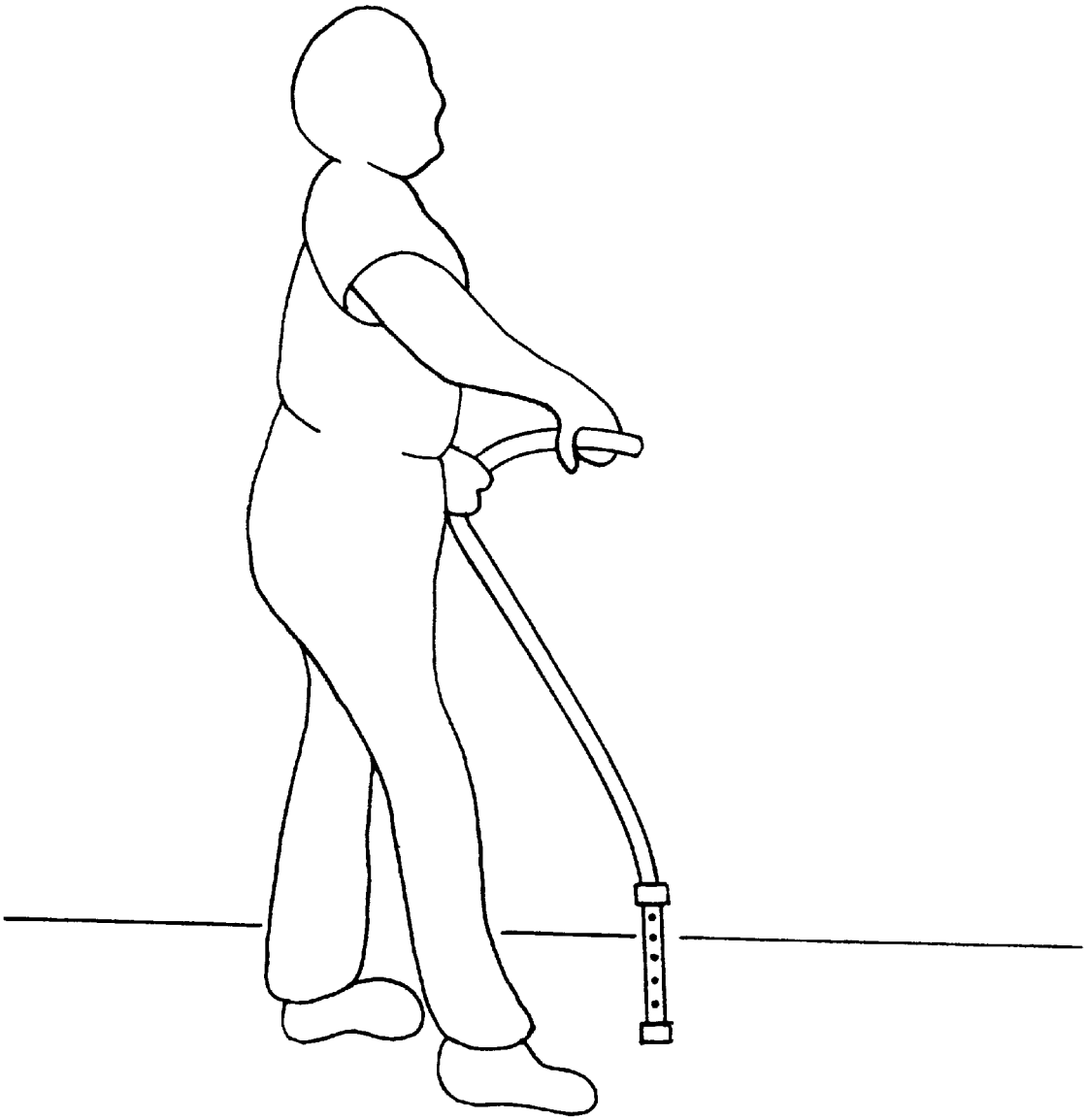
Figure 2C:
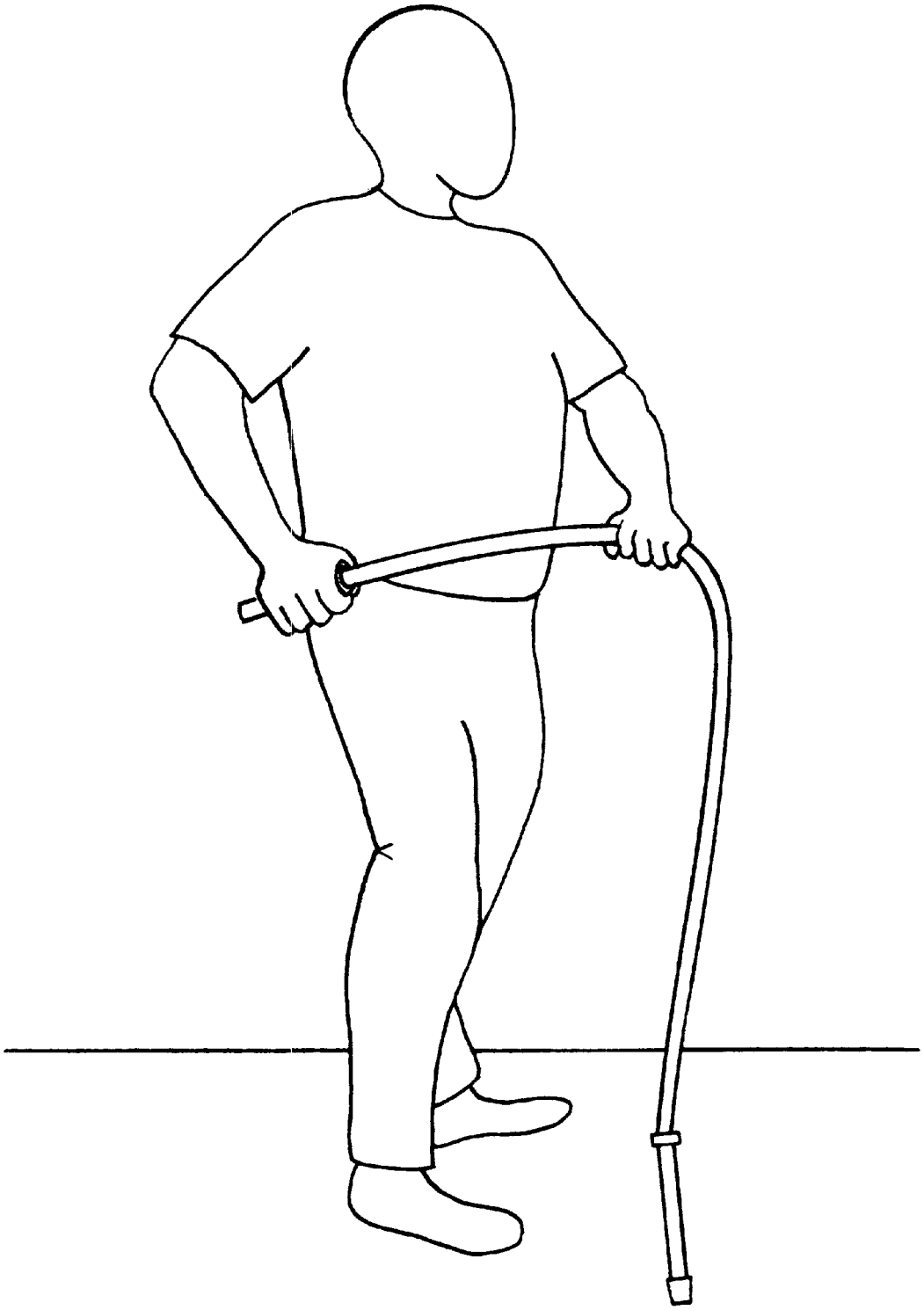
Figure 3A:
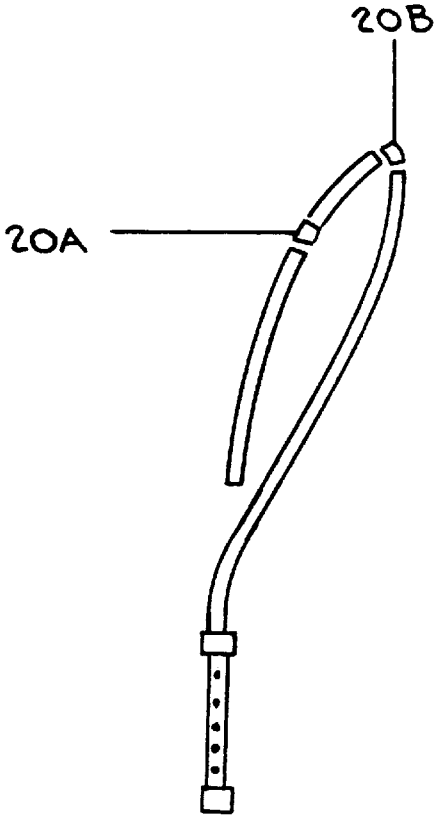
FIG. 3A to 3B shows the possible breakdown of the two possible hinge placements of the one-legged-two-handed walking aid device.
Figure 3B:
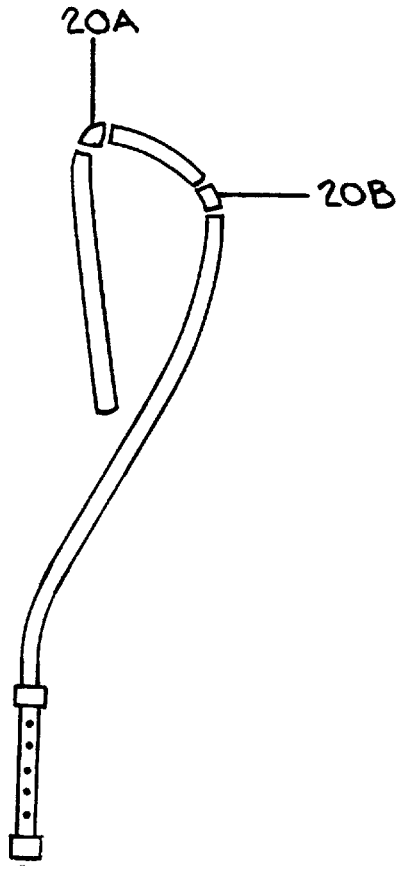
Figure 7:
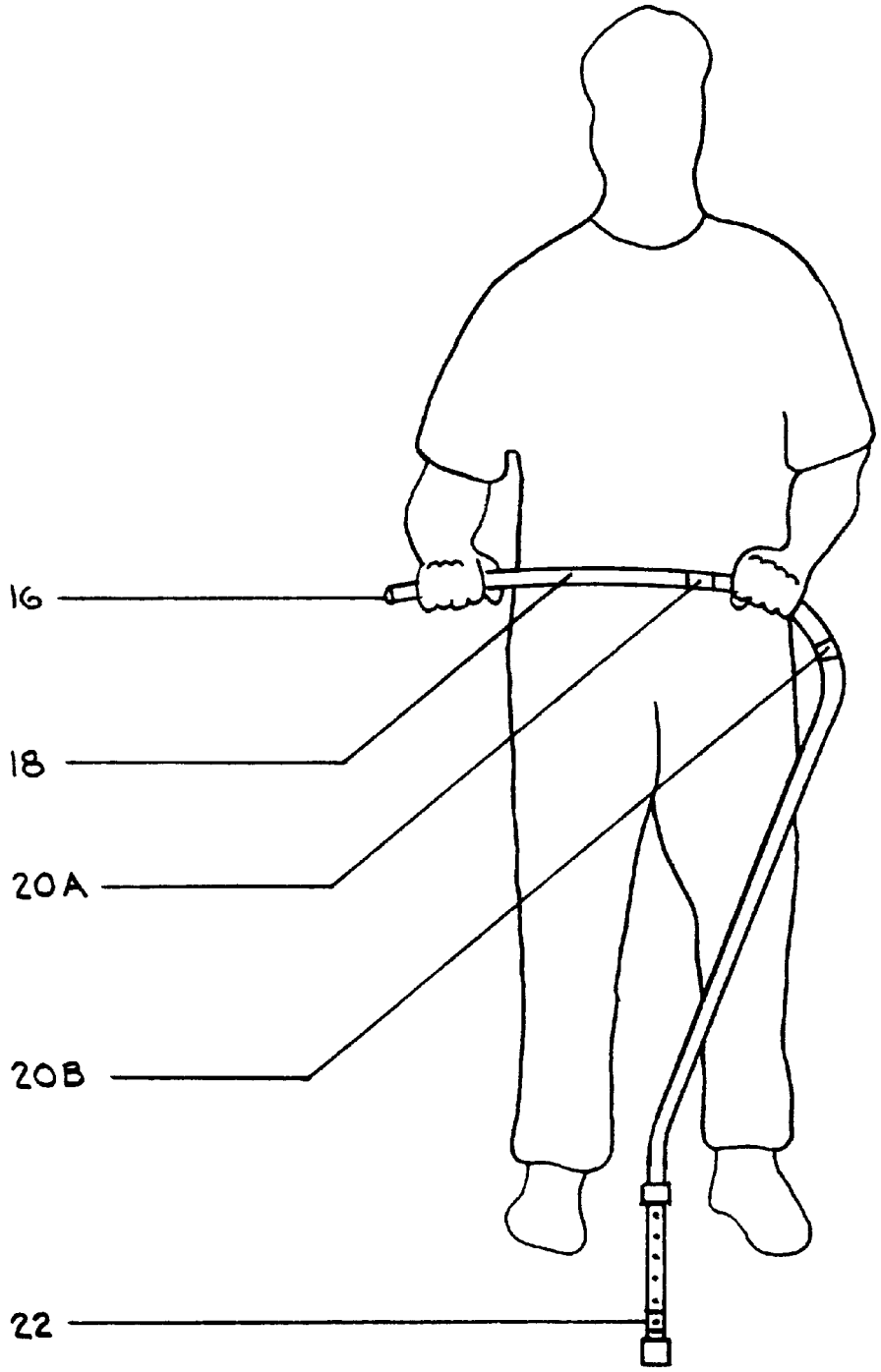
FIG. 7 shows optional features of the one-legged-two-handed walking aid device.

FIG. 7 shows possible placement of added features such as an end cap (16) on the end of the handle member (08), the handle member(08) should be padded (18) with a soft, durable material that minimizes slipping of the hands when the hands perspire. Also, the hand grip padding(18) should cover the entire handle member (08) from hand grip (18) to hand grip (18) except if the hinge (20A) FIG. 7 should be placed to the inside of the appendage member side hand grip (18). This area may or may not be covered, thus, if the hinge (20B) were placed in the bend between the handle member (08) and the appendage member (10) the hand grip padding (18) would entirely cover the handle member (08). The one-legged-two-handed walking aid device can be broken down for storage FIG. 3A by means of releasing the hinge (20B) and folding the handle member (08) to the appendage member (10) by said means, making the apparatus more compact. Also, if the hinge (20A) were to be disengaged and the handle member (08) folded to the appendage member (10) FIG. 3B) the one-legged-two-handed walking aid device would be used as a single handed cane.

Another possible feature is a swivel (22) FIG. 7) located just above the foot pad (12) made of tight construction that will allow the foot pad (12) to remain stable and in place on the walking surface and does not allow any movement other than the rotation of the leg shaft (10).

Figure 4:
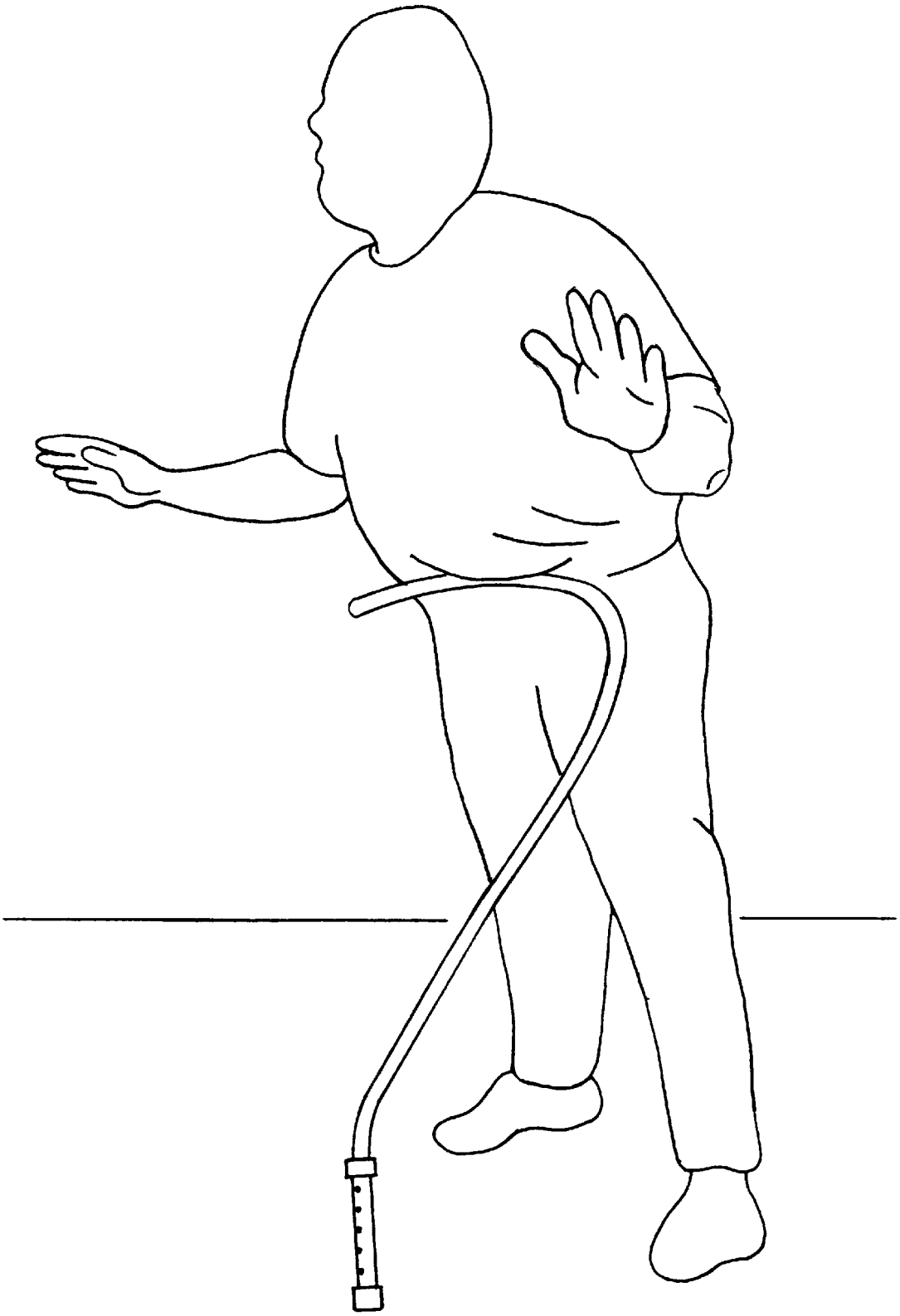
FIG. 4 shows a hands free leaning position on the one-legged-two-handed walking aid device.

FIG. 4 shows a hands free leaning position on the one-legged-two-handed walking aid device.

Figure 8:
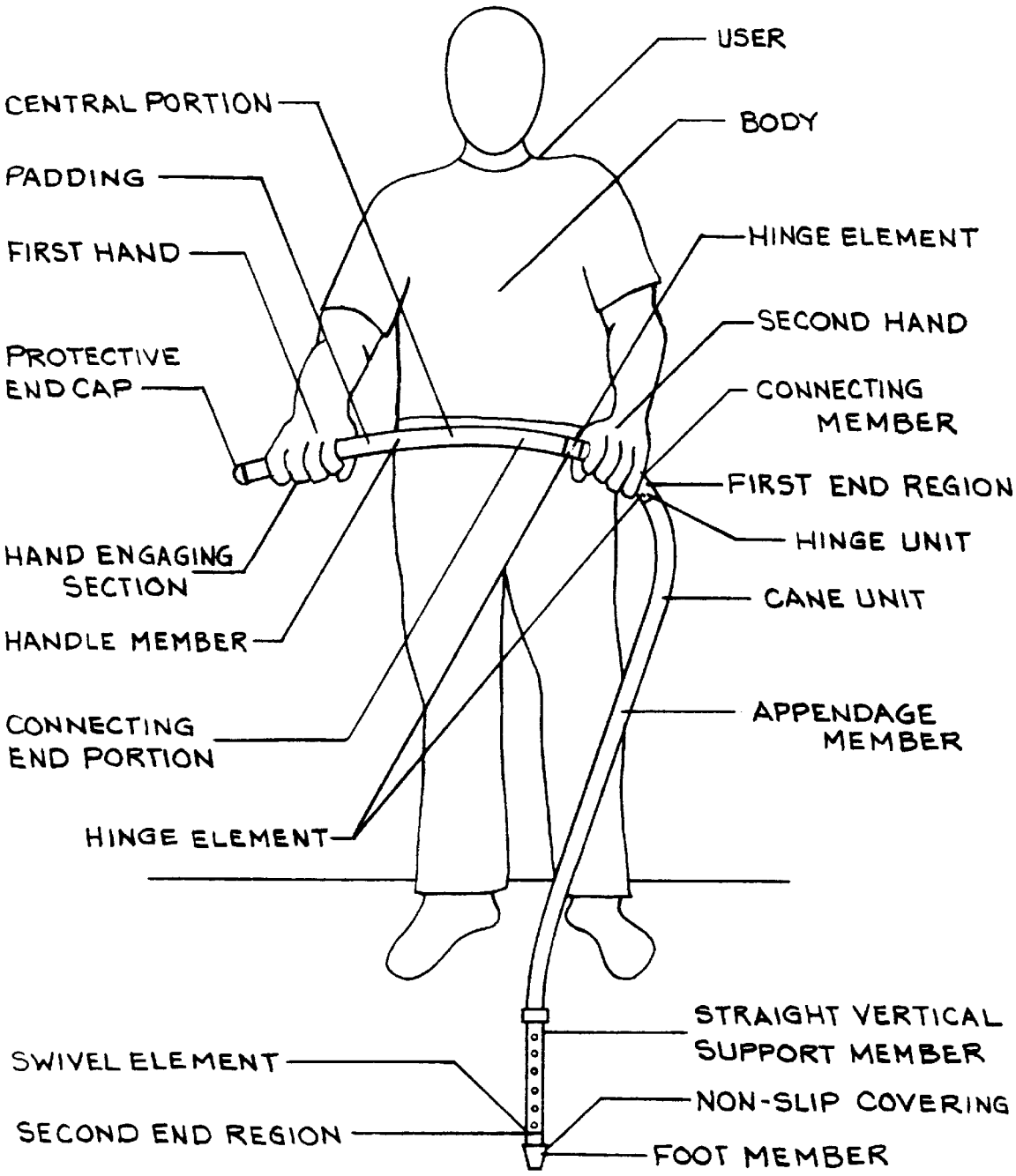
FIG. 8 shows an alternate descriptive view of the user and the one-legged-two-handed walking aid device.

FIG. 8 shows an alternate descriptive view of the user and the one-legged-two-handed walking aid device.

OPERATION

When the user starts the walking process with the one-legged-two-handed walking aid device, the hands are positioned on the handle member at the hand grip area about waist high. The foot of the one-legged-two-handed walking aid device is positioned forward and to the center away from the user. For a right-handed person the left hand serves as a pivot and the right hand incorporates a rowing motion, while both hands, arms and shoulders take on some of the weight of the body. (Reversefor a left-handed person). See FIGS. 1A, 1B, 1C and FIGS. 2A, 2B, 2C. Also, with this stride-motion effect with the arms, as the user comes closer to the one-legged-two-handed walking aiddevice appendage member, the one-legged-two-handed walking aid device becomes taller in height due to the angle position. Thus, a climbing effect is automatically incorporated. The user, while pulling forward is actually pulling the body upward creating a climbing effect relieving the stress on the lower extremities. The user is actually talking advantage of the upperbody to compensate lower body disadvantages. With this one-legged-two-handed walking aiddevice this is achieved with the natural and comfortable walking abilities that most all humanbeings possess.

SUMMARY, RAMIFICATIONS AND SCOPE

Canes and walkers are effective in their own right. The cane is good for steadying oneself in some cases, although having one hand free does not allow a means of support when both hands are needed. The walker requires both hands for support and steadiness. Momentum is greatly hampered due to the intended method of use and design. In considering these downfalls, this invention of the one-legged-two-handed walking aid device reduces these disadvantages and creates new advantages. Having the design compatible with the shape of the body, using two hands for stability and only one leg, means less cumbersome walking conditions. The user may very well become confident and comfortable in many otherwise uncomfortable situations.

The one-legged-two-handed walking aid device provides versatility and convenience to persons using waking aides by having a single appendage to allow easier access in compromising situations, it provides stability by allowing the use of two hands, it provides better mobility by the design being compatible with the natural movement of the body, and comfort is provided byrelieving stress and fatigue normally associated with other types of walking aides.

Although the description above contains the specifics of this invention these should not be construed as limiting the scope but rather provides some preferred embodiments. Some examples of its ramifications are listed below.

The one-legged-two-handed walking aid device may be manufactured for the right or left handed persons. Not to say that a left handed person would not be able to use the right-handed one-legged-two-handed walking aid device, but could easily do so with a little coaching. The same would hold true for a right handed person using a left handed device. It may be manufactured with a hinge just to the inside of the appendage side hand grip, which will allow the one-legged-two-handed walking aid device to double as a single-handed cane in situations where onehand is needed for something other than balance or stability, or in the bend at the union of the handle and appendage members a feature added to allow folding when in transport or for storage. This makes for maximum compactness. When the hinge is incorporated at the inside of the appendage side hand grip the handle can be folded down and the one-legged-two-handed walking aid device canbe used as a single handed walking device. Also, the one-legged-two-handed waking aid device may further include a continuous padding across the handle member and an end cap at the blunt end of the handle member.

The one-legged-two-handed walking aid device may incorporate a swivel for pivoting the appendage to aide in the twisting, or pivoting, action when in use. This may prolong the life of the foot pad. The swivel should be made of a tight construction which will not freely move but will allow for movement of the appendage.

Thus, the scope of the invention should be determined by the appended claims and their legal equivalents, rather than by the examples given.

What I claim is:

1. A walking aid device that allows a user having a body and a pair of hands to use both hands on a single device appendage to support the weight of the body of the user, said device comprising:

(a) a horizontal, elongated handle member having a first end and a second end, and curved in a plane parallel to the walking surface having a first hand-engaging member disposed directly interior to the first end of said handle member, (b) a second hand-engaging portion disposed just interior to the second end of said handle member, (c) a connecting member connected to said second end of handle member, said connecting member having a three-dimensional curve that is downward from said handle member, inward toward the center of said handle member and outward from the body, (d) an appendage member connected to said connecting member, said appendage member being curved away from the body toward a position directly in front of the body, (e) a straight vertical support member of adjustable length connected to said appendage member, and (f) a foot member connected to said vertical member for contacting the ground.

2. The device of claim 1 wherein said handle member has (i) the hand engaging end portion, (ii) a connecting end portion, and (iii) a central portion extending between said hand engaging portion and said connecting portion, said hand engaging portion having a protective end cap.

3. The device of claim 1 wherein said device has a slippage resistant protective padding on said handle member.

4. The device of claim 1 wherein said device has a hinge element in said handle member just to the inside of said second hand engaging portion to permit said handle member to be folded to permit said device to be converted to a single hand cane walking aid configuration.

5. The device of claim 1 wherein said device has a hinge unit which connects said connecting member to said appendage member to permit said device to be folded into a compact configuration for storage.

6. The device of claim 1 wherein said device comprises a swivel element connecting said foot to said vertical support member for permitting the device to be turned along an axis parallel to said support member without causing wear on the bottom surface of the foot member.

7. The device of claim 1 wherein said foot has a protective non-slip covering to prevent accidental slippage of the device during use.

* * * * *